United States Patent [19]

Franke

[11] 4,054,632

[45] Oct. 18, 1977

[54] METHOD FOR FORMING HOT MELT ADHESIVES INTO A READILY PACKAGEABLE FORM

[75] Inventor: Willard A. Franke, St. Paul, Minn.

[73] Assignee: H. B. Fuller Company, Saint Paul, Minn.

[21] Appl. No.: 301,574

[22] Filed: July 26, 1972

Related U.S. Application Data

[60] Division of Ser. No. 85,158, Oct. 29, 1970, Pat. No. 3,723,035, which is a continuation-in-part of Ser. No. 824,244, May 13, 1969, abandoned.

[51] Int. Cl.[2] ..... B29F 3/08; B29E 17/10

[52] U.S. Cl. ..... 264/145; 264/148; 264/157; 264/176 R; 264/237

[58] Field of Search ..... 264/141, 142, 148, 151, 264/176 R, 176 F, 143, 145, 237, 157; 425/401

[56] References Cited

U.S. PATENT DOCUMENTS

| | | | |
|---|---|---|---|
| 2,053,920 | 9/1936 | Schade et al. | 425/461 |
| 2,256,483 | 9/1941 | Johnston | 264/178 R |
| 2,386,411 | 10/1945 | Taylor | 425/70 |
| 2,464,746 | 3/1949 | Gering | 264/141 |
| 2,862,243 | 12/1958 | Farr et al. | 264/178 R |
| 2,887,725 | 5/1959 | Vickers et al. | 264/141 |
| 2,919,465 | 1/1960 | Heiserman et al. | 264/180 |
| 3,012,282 | 12/1961 | Donald | 264/141 |
| 3,046,606 | 7/1962 | Carter | 264/141 |
| 3,334,167 | 8/1967 | Kenney | 264/167 |
| 3,343,214 | 9/1967 | Myers | 425/461 |
| 3,344,218 | 9/1967 | Chopra et al. | 264/37 |
| 3,519,706 | 7/1970 | Pantsios | 264/143 |
| 3,519,706 | 7/1970 | Pantsios | 264/143 |
| 3,555,947 | 1/1971 | Fram | 83/347 |
| 3,655,850 | 4/1972 | Woodham et al. | 264/141 |

FOREIGN PATENT DOCUMENTS

| | | | |
|---|---|---|---|
| 1,145,029 | 10/1957 | France | |
| 774,681 | 5/1957 | United Kingdom | 264/142 |
| 828,206 | 2/1960 | United Kingdom | 264/141 |
| 962,843 | 7/1964 | United Kingdom | |

OTHER PUBLICATIONS

Skeist, Handbook of Adhesives, Reinhold (N.Y.) (1963), pp. 447–449, relied on.

Whittington, Whittington's Dictionary of Plastics, Technomic, Stamford, Conn., 1968, pp. 187 & 188, relied on.

*Primary Examiner*—Willard E. Hoag

*Attorney, Agent, or Firm*—Norman P. Friederichs

[57] ABSTRACT

An improved method for handling of materials having characteristics such that they are normally solid at room ambient temperatures and are prepared and used at elevated temperatures to transfer the form of the material to a liquid. The improved method provides for handling of the material in liquid form and extruding it as a stream or continuous flow, cooling the outer surface of the same to solidify it and severing the stream of material with the hardened exterior and liquid interior such that the individual segments severed therefrom seal themselves and form individual pillow-like segments which can be then further cooled to a hardened state and readily handled, packaged, shipped and used.

13 Claims, 10 Drawing Figures

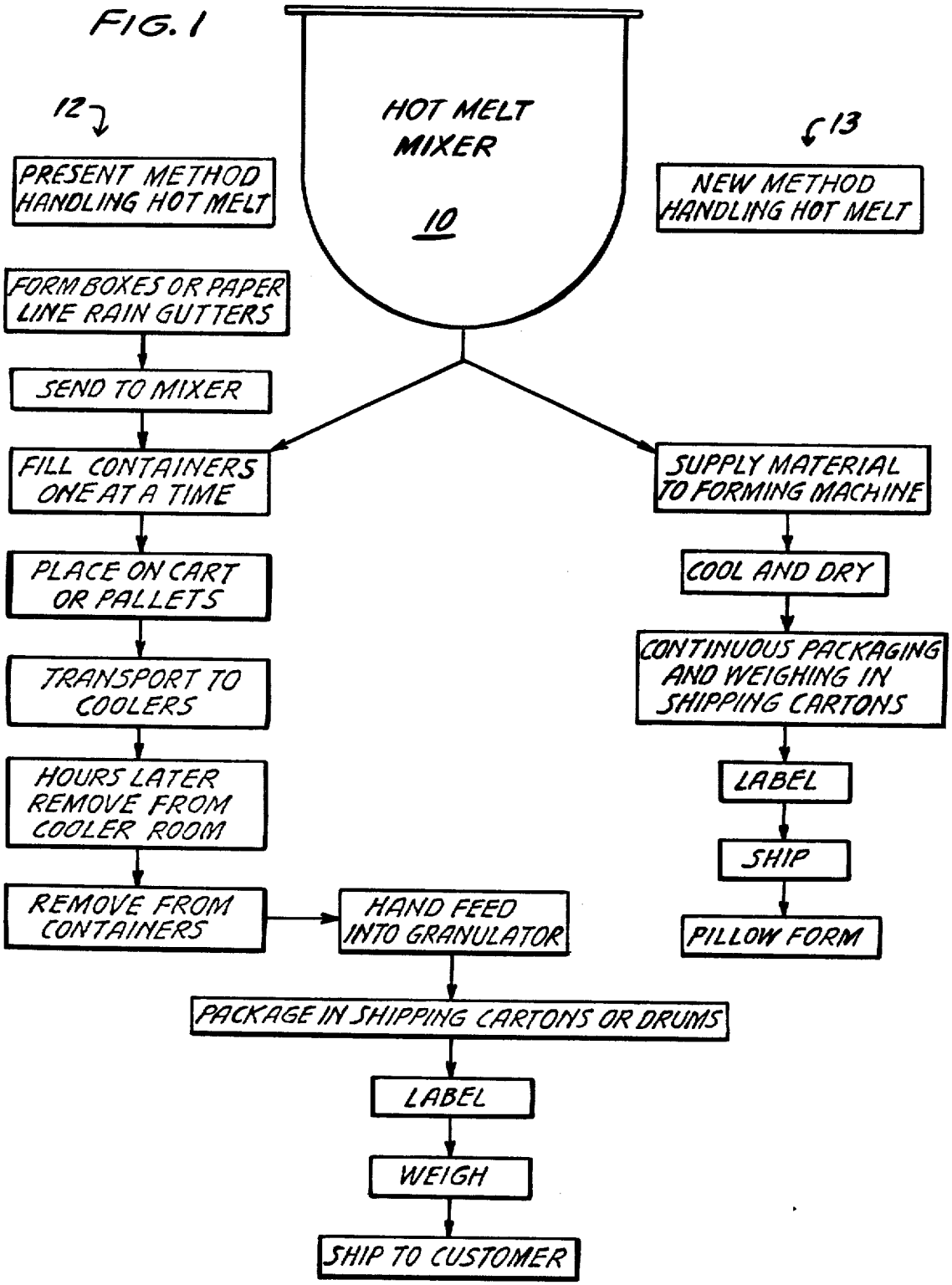
FIG. 1
HOT MELT MIXER
10
12
PRESENT METHOD HANDLING HOT MELT
FORM BOXES OR PAPER LINE RAIN GUTTERS
SEND TO MIXER
FILL CONTAINERS ONE AT A TIME
PLACE ON CART OR PALLETS
TRANSPORT TO COOLERS
HOURS LATER REMOVE FROM COOLER ROOM
REMOVE FROM CONTAINERS
HAND FEED INTO GRANULATOR
13
NEW METHOD HANDLING HOT MELT
SUPPLY MATERIAL TO FORMING MACHINE
COOL AND DRY
CONTINUOUS PACKAGING AND WEIGHING IN SHIPPING CARTONS
LABEL
SHIP
PILLOW FORM
PACKAGE IN SHIPPING CARTONS OR DRUMS
LABEL
WEIGH
SHIP TO CUSTOMER

METHOD FOR FORMING HOT MELT ADHESIVES INTO A READILY PACKAGEABLE FORM

CROSS-REFERENCE TO RELATED APPLICATIONS

This is a division of application Ser. No. 85,158, filed Oct. 29, 1970 and now U.S. Pat. No. 3,723,035, which was a continuation-in-part of Ser. No. 824,244, filed May 13, 1969, and now abandoned.

My invention relates to an apparatus and method for packaging materials normally solid at room ambient temperature and in particular to a machine and method for simplifying the packaging of hot melt adhesives or equivalent material in readily packageable form.

At the present time, the packaging of hot melt adhesives and materials of this type require extensive machinery and handling and normally require placing the material in heated form into containers, large or small, cooling the same, and handling of the containers for a special cooling operation followed by either packaging or further refinement into a form in which it could be packaged and shipped to a user. Materials of this type are products which are normally solid at normal atmospheric temperature and become liquid in a range from 125° to approximately 450° F. In the manufacturing of this material, which comes from the manufacturing process in liquid form and requires the intermediate stage of packaging and cooling with special equipment, the further disadvantage of exposure to gases and hot liquids is also present.

In the improved method and apparatus for packaging materials of this type, such as hot melt adhesives, the material is taken in liquid form and supplied to an improved machine which extrudes or forces the material through an orifice or restriction to form a stream which is immersed in a cooling medium, such as water, so that the exterior or exposed surface of the stream hardens, providing a generally tubular form of material which is cut into predetermined length segments in the presence of the cooling medium and under conditions such that the individual segments with the solid exterior and liquid interior seal themselves into pillow-like packages which are further emersed in the cooling medium until sufficiently solidified to be removed therefrom wherein final cooling and packaging in bulk form permits a simplified product which is readily usable by a consumer. In the improved apparatus for performing the method, a simplified structure is provided which will receive the material in liquid form and pump it through the restriction or orifice into a container of the cooling medium, such as water which is recirculated to be maintained at a particular temperature. The stream of material as it is immersed in the cooling medium hardens on the surface and is guided in a trough-like guide structure toward a rotating cutter which severs or pinches off the stream into predetermined lengths continuously and at a high rate to enable handling of a large volume of the material with the individual segments being cooled and transported for further drying in bulk form as a plurality of individual segments each forming their own package. Subsequent handling merely requires placing a sufficient number of such segments in shipping packages and weighing the same. This requires no special packaging as far as the particular carton is concerned and the method and apparatus provides a readily usable form of the material for the consumer. The improved forming machine permits the pinching or severing of segments with a rotary knife wherein the individual segments are passed between the cutter and the supporting the roller without destroying or altering the form of the segment or the seal therein.

An alternate embodiment of the machine includes provisions for handling the segments, that is removing them from the bath of cooling medium, drying the same and propelling or moving the segments to a place of packaging.

Therefore, it is the principal object of this invention to provide an improved method of packaging a material, such as a hot melt adhesive.

Another object of this invention is to provide an improved and simplified apparatus for packaging a hot melt adhesive.

Another object of this invention is to provide a hot melt adhesive or similar material in readily packaged form wherein the material itself forms its own package such that it may be moved and handled in bulk form.

Another object of this invention is to provide in an apparatus of this type a simplified cooling and severing mechanism which will maintain the shape of the segments and cool the same such that they may be readily handled without destroying the form or permitting leakage therefrom.

A further object of this invention is to provide an apparatus of this type which includes forming a plurality of segments from a plurality of streams of the hot melt adhesive severing the streams to form the segments, cooling and drying the segments and moving the same to a place of packaging.

These and other objects of this invention will become apparent from a reading of the attached description together with the drawings, wherein:

FIG. 1 is a diagrammatic view of the steps employed in handling material, such as a hot melt adhesive, from the manufacturing or mixing stage through the packaging stage to the ultimate shipping stage as presently used compared with the steps required in the new method or process for the same under the present invention;

Figure 2:
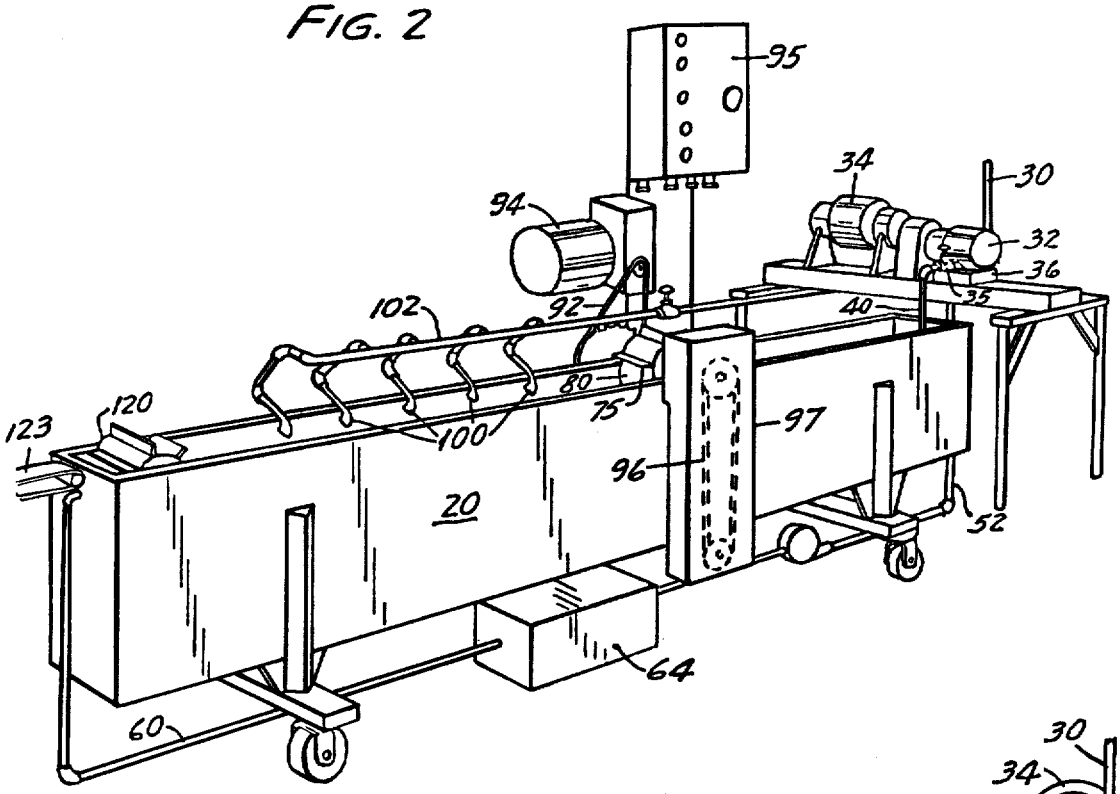
FIG. 2 is a perspective view of an apparatus to perform the improved method of packaging a hot melt adhesive.

My improved method and apparatus for packaging materials is shown herein as particularly adaptable to materials, such as hot melt adhesives. Such materials are normally set up and harden at temperatures below a minimum of 125 degrees F. These are resinous type adhesives formed of polyesters or polyamides and, depending upon the consistency, solidification will take place between 125° and 450° F. The process, however, is equally applicable to animal glue type adhesives. Above these temperatures, and in the preparation and application form, the materials become liquid or fluid. In FIG. 1, I have shown in block form the present method in steps of the handling such materials compared with the proposed method in steps of the present invention. Thus at 10, a mixing vat or apparatus representing the manufacturing or mixing process for such materials is shown with the material at this stage being at an elevated temperature or above solidification temperature necessary for the preparation of the same. Under the present method of handling such materials, the material is packaged in a variety of forms varying from chunk, to rain gutter, cake, granulated, block shape and other forms, each of which requires separate packaging and processing from the mixed finished and fluid state. Thus, as shown generally at 12, the present method of handling such materials requires the formation of boxes or preparation of suitable containers and the placing of such containers at the discharge point from the mixing apparatus so that the suitable containers may be filled in sequence one at a time. At this point, the filled containers are moved in open form with the material in fluid state and giving off fumes to a point where the containers with the fluid therein are cooled. At this point and depending upon the desired ultimate product shape, the material or adhesive in solid form is removed from the containers and packaged in shipping cartons or drums for ultimate shipment to a consumer. Where such products are to be in granular form, the bulk blocks are further refined by grinding before packaging as indicated in FIG. 1.

Under the improved method, as indicated at 13, the material in fluid form is directed to the apparatus performing the method which provides an arrangement wherein the material forms its own seal or packaging and is removed in bulk form through suitable conveying apparatus to a point where the same is cooled and dried to provide the final solidification of the packaged material. At this point it may be weighed and packaged into any suitable shipping carton and shipped or otherwise delivered to a consumer. The improved product, as will be hereinafter identified, is a pillow-like form of the material without any coating or casing around the same except for the actual shipping container wherein a given quantity by weight of such segments or pillow-like blocks are contained within a container. This permits the ultimate consumer to have the material or adhesive in easily handled form so that it may be readily used in its application as an adhesive.

My invention is particularly applicable to thermoplastic synthetic resins with additives, such as resin and wax or other film formers, to use in the packaging industry for carton sealing, book binding and other uses. This particular material sets up almost instantly and requires a high temperature for application purposes. In its presently packaged form, such as in drums, the problem of removal of the material increases costs and handling while in pellet form, the machinery involved in the granulating or pelleticizing increases production costs of the same. In intermediate block size form, special packaging and cutting is required, further increasing the manufacture and shipping costs. The improved method eliminates a filling operation together with associate waste and increases the rate of production while reducing packaging costs.

Figure 3:
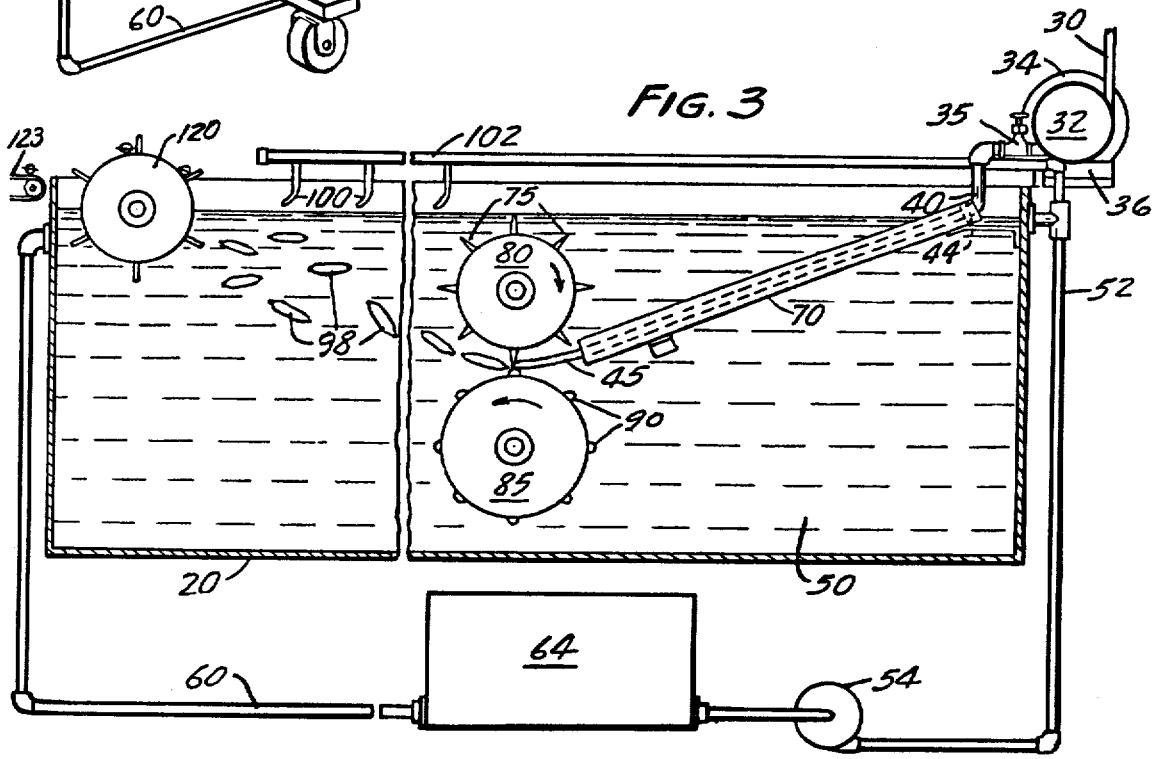
FIG. 3 is a longitudinal sectional view of the apparatus of FIG. 2 with parts broken away.

In FIG. 2, an apparatus for performing this improved method is shown. This apparatus includes a cooling tank 20 which would be normally positioned adjacent or in near relationship to the production machinery for making the adhesives or hot melts. The packaging apparatus would be fed by appropriate pipe 30 wherein the material would flow in liquid form from this production apparatus or mixer, indicated previously at 10. Connected to the inlet pipe 30 of the packaging machine is a pump 32 driven by an appropriate motor 34 and having associated therewith a control valve 35 with a suitable heater 36 positioned adjacent the valve to maintain the level of the temperature of the fluid into the packaging machinery. The outlet pipe of the valve, indicated at 40, includes a stream forming orifice or restriction 44 which would be located adjacent thereto and in a position to direct a stream 45 of the hot melt adhesive in liquid form into the cooling tank, indicated generally at 20. The cooling tank contains a cooling medium, indicated generally at 50, which is normally recirculated chilled water. As shown schematically in FIG. 3, an inlet pipe 52 has associated therewith a circulating pump 54 which directs water into the container at one extremity with the water being removed and recirculated through a pipe, indicated at 60, and to a cooling chamber 64, having associated therewith a suitable heat exchanger, such as a refrigerator unit, for the purpose of maintaining water temperature at a predetermined level during the packaging process. The pump 32 and valve 35 control the flow of the hot melt adhesive into the cooling tank and direct such flow in a continuous stream form such that when the stream comes in contact with the cooling medium, such as the chilled water, the outer surface of the stream has its temperature rapidly changed to solidity the same forming a sealing coating around the stream. The stream of material thus becomes a semi-hard extrusion generally cylindrical in form and capable of being directed toward an approprite cutting device, to be hereinafter identified. A trough or other guide structure, such as is indicated at 70 and positioned in an inclined attitude within the container 20, guides the stream 45 to the cutting knives, indicated generally at 75 and positioned on a rotary drum 80 located adjacent the extremity of the trough 70. Cooperating with the drum 80 having the knives 75 thereon, is a suitable cushion drum 85 with knife emgaging and protruding cushion surfaces 90 thereon which cooperate with the knife extremity of the blade 75 to perform the severing operation on the stream of adhesive. As will be seen in FIG. 1, the cutting device is located beneath the surface of the cooling medium within the tank. The drum 80 carrying the knives 75 is driven through a suitable chain or drive structure 92 connected to a driving motor 94 located on the container 20 with a suitable control panel 95 for controlling the operation of the same. This drive structure is also connected to the cushioning drum 85, through a secondary set of chains and sprockets 96 which are enclosed at 97, with the drums being suitably journaled in the tank for counter rotation therein. Movements of the drums 80 and 85 are synchronized through the drive structure so that the knife blades 75 cooperate with the cushioning surfaces, such as a compressible plastic material, on the cushioning drum enabling the knife blades to press into the cushioning material for severing of the solidifying stream of material without dulling the knife surfaces. Normally, the drums 85 and 80 are made of a metallic material and the knife blades, as indicated at 75 as well as the cushions 90, are distributed about the surface of the respective drums in equal spacing and number, with the blades being of such length that the actual surfaces of the drums will be spaced apart allowing passage of the severed segments 98 of the stream of solidifying adhesive or material to pass between the same. The actual cutting of the stream into segments 98 takes place initially as a pinching action since the stream with its semihard exterior surface which is flexible encloses a molten or liquid center and as the knife blades engage the cushioning surface, the outer solidified casing is pinched together and severed. This action seals the remaining portion of the stream in liquid form within the container formed by each of the segments. The individual segments are passed between the drums and suitable means are employed for maintaining the severed segments or pillows emersed in the cooling medium to continuing the cooling and hence hardening of the surface such that the individual segments will not break and discharge the liquid portion remaining in the center of the same. In FIGS. 2 and 3, this circulation means includes a plurality of jet sprays 100 positioned above the tank which are supplied from the pump 54 through a pipe 102 connected to inlet pipe 52, which sprays cause circulation of the water in the container 20 and depression of the segments 98 of hot melt adhesive in semi-liquid form with the solidified exterior surface. The density of the adhesive is such that the same is less than the cooling medium and will normally float to the surface. The circulating water will direct the cooling segments toward one end of the container where they are removed by a suitable wheeled type paddle structure 120 which lifts the segments onto an appropriate belt type conveying structure 123 to be moved away from the container 20 and to a point of further cooling and drying, as indicated in the block diagram of FIG. 1.

Figure 5:
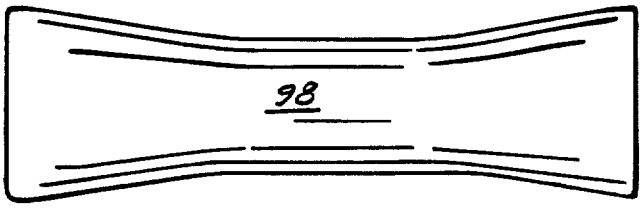
FIG. 5 is a plan view of a segment or block of the hot melt adhesive in packaged form.
Figure 6:
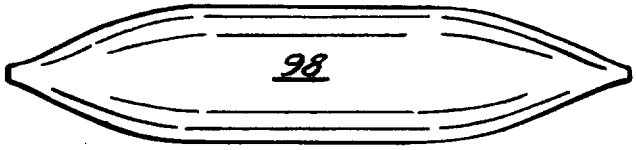
FIG. 6 is a side elevation view of the segment of FIG. 5.
Figure 7:
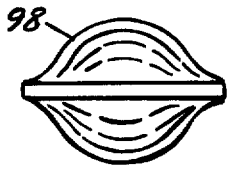
FIG. 7 is an end elevation view of the segment of FIG. 5.

The individual segments in severed form are shown in plan, elevation and end views in FIGS. 5, 6 and 7 in the drawings which, when severed, will have a trough sealed extremity or surface and be molten and liquid on the interior and which when allowed to cool will harden throughout to provide a self-packaged segment of the adhesive which is readily handled and shipped and used. It is generally of a pillow-like form of approximately 3 to 3-½ inches in length and ½ to ¾ inch in diameter. The physical dimensions of the same can be controlled by the size of the orifice and pump together with the speed of operation of the cutting cylinder and the number of knives thereon.

Figure 4:
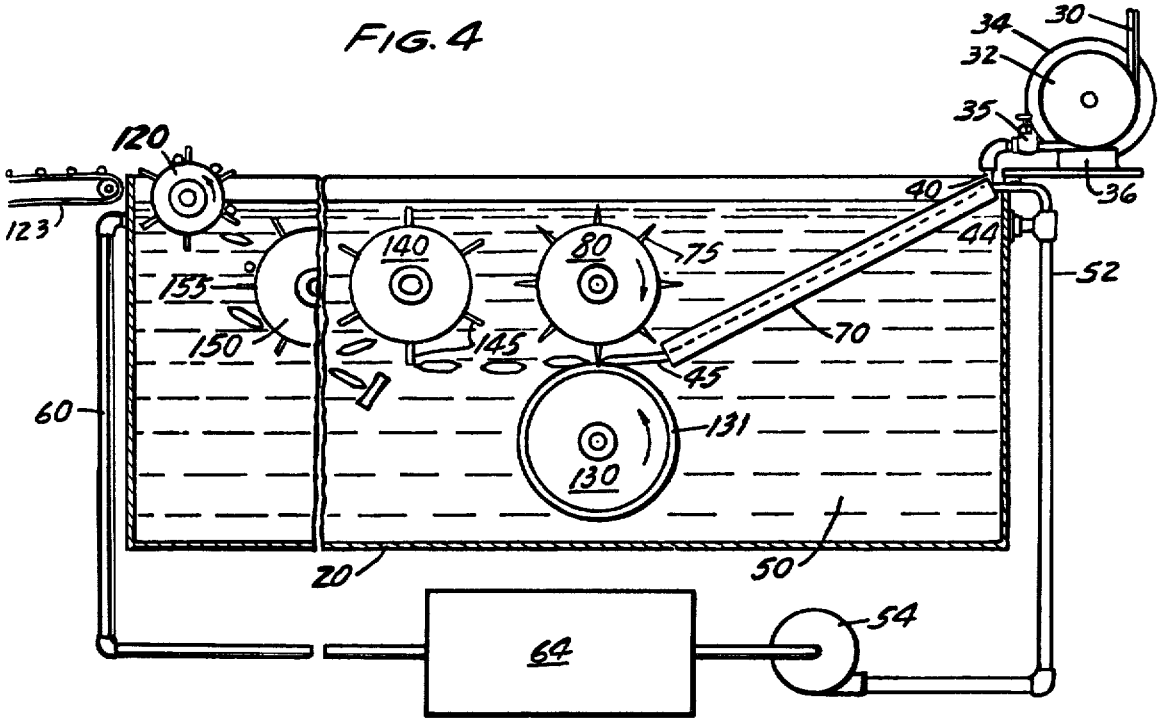
FIG. 4 is a longitudinal sectional view of the alternate embodiment of the apparatus to perform the new method of packaging the hot melt adhesive.

FIG. 4 shows an alternate version of the cutting portion of the apparatus in which the cushion cylinder is a generally cylindrical structure without the cushion pads for the knives. Thus in FIG. 4, the cylinder 130 is equivalent to the cushion drum 85 without the cushion pads 90 thereon and the entire peripheral surface of the same is made of a compressible material, as at 131, to cooperate with the knife edge surface of the cutting knives 75 to pinch off the various segments of the stream of the adhesive in envelope or semi-hardened form without requirement of the synchronization of the knives with the cushion pads. In this embodiment, the cooling medium, in addition to being directed to the container 20, is also specifically circulated through the trough 70 to provide a surface of water contacting the stream of material in fluid form as it is pumped from the pump 32 and valves 35 to initially harden the surface of the same forming the tubular stream of material directed down the trough 70 and toward the cutting structure. The cooling medium generally has a density greater than the density of hot melt stream 45 and thus hot melt stream 45 will normally float towards the surface of the cooling medium and hot melt stream 45 will thus be "supported" by the cooling medium while in trough 70. In this embodiment, the knife drum 80 with the knives 75 thereon will take the same form and with the knives being of such length to provide sufficient clearance between the surface of the cushion drum 130 and the knife edge to allow for passage of the severed segments thereon. The pinching action of the knives bearing against the cushion drum may slightly alter the form of the individual segments as disclosed in FIGS. 5–7, but the actual pinching and severing of the hardened surface of the stream will similarly effect the seal at each end of the segment as it is severed and allow the portions that are severed to pass between the cutting drum and the severing drum. An alternate version of cooling of the segments is shown in the pair of transporting and circulating drums, indicated generally at 140 and 150. These drums have paddles 145 and 155 thereon which direct the segments floating free from the cutting drum and cushion drum in a path to submerse the same in the cooling medium and to elevate the same to the surface where it can be transferred to the lifting drum 120 and conveying apparatus 123 for bulk handling in the cooling and ultimate storage of the segments.

Figures 8, 9, 10:
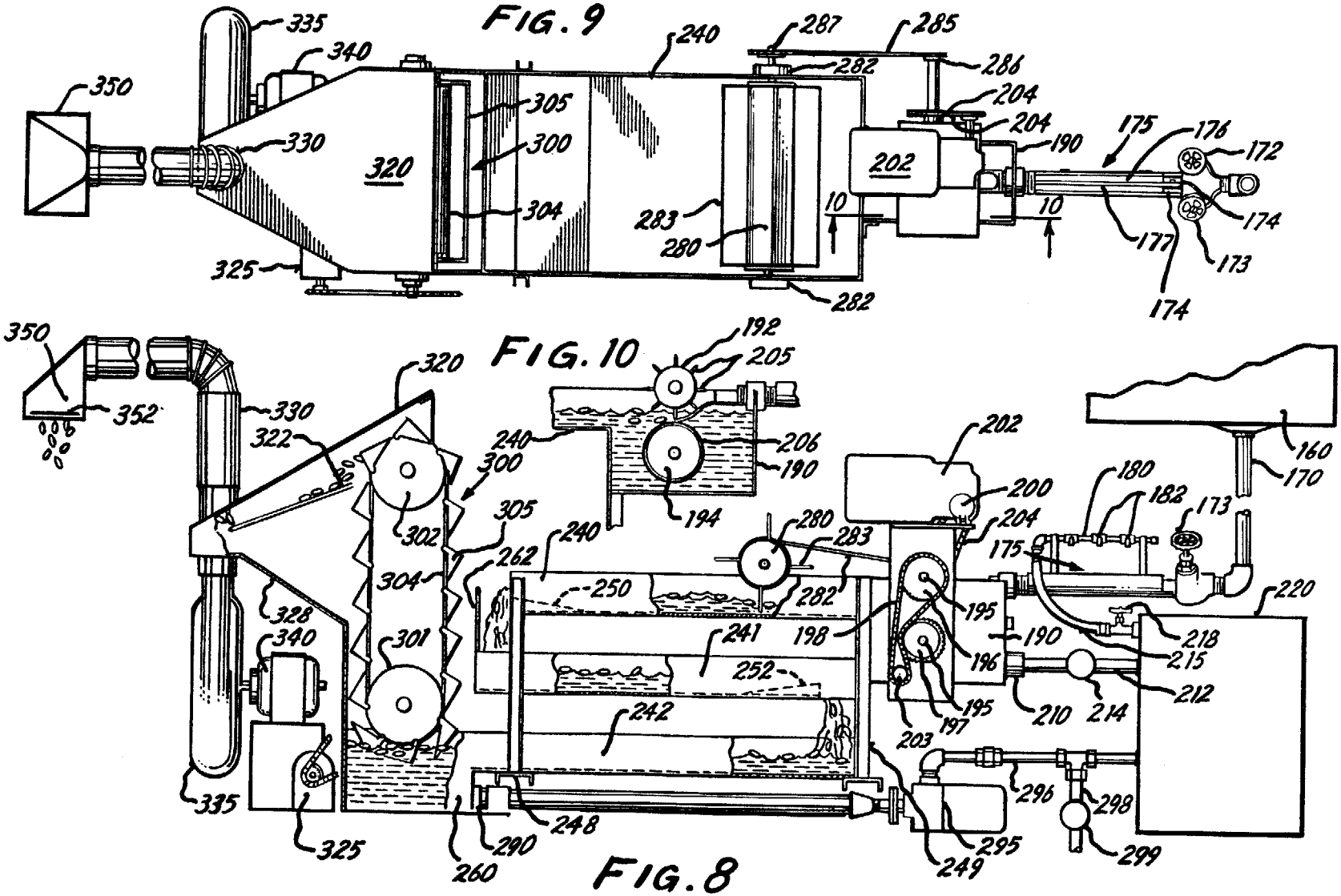
FIG. 8 is a side elevation view of an alternate embodiment of the improved apparatus for packaging hot melt adhesive.
FIG. 9 is a top elevation view of the apparatus of FIG. 8.
FIG. 10 is a sectional view of a portion of the apparatus of FIG. 9 taken along the lines 10-10 therein.

The embodiment shown in FIGS. 8, 9 and 10 discloses a refined and more complete version of the apparatus of the before-mentioned embodiment. As indicated in these figures, the source of hot melt adhesive from the mixing chamber 160 is directed from a remote location through an insulated conduit or pipe 170 which may or may not include a pump and heater to the discharge orifice end of the same wherein a pair of control valves 172, 173 are located to define the flow through the pipe or conduit into two separate streams. Although I have shown apparatus for handling only two streams of liquid hot melt adhesive, it will be understood that the apparatus may be designed to handle a plurality of streams. The size of the streams after cutting defines separate discrete segments of varying shapes and mass. The discharge orifice extremity of the valves, indicated at 174, are directed into a trough-like structure 175 having a pair of curved surfaces 176, 177 generally semi-circular in cross suction into which the separate streams of liquid hot melt adhesive are directed. These streams are cooled and solidified by means of chilled water directed thereon from an overhead spray unit 180 having a plurality of spray jets 182 positioned therein. The partially solidified streams with a hardened outer surface will be directed through the extent of the trough and into a box-like cutter housing 190 positioned at the extremity of the same. This box-like structure mounts the cutting and cushion wheels which will best be seen in FIGS. 10 at 192, 194 respectively. These are journaled on shafts 195 and driven from sprockets 196, 197 mounted outside the confines of the box-like structure and connected together through a suitable belt 198. As indicated in FIGS. 8 and 9, an overhead motor 200 mounted in a frame 202 is connected by means of a chain drive 204 to a pulley 206 attached at the opposite end of the upper shaft mounting the cutting roller or drum 192 for the purpose of driving the same. The belt 198 threads over the pulleys 196, 197 at the opposite side of the case and over a tension pulley 203 to drive the cushion roller 194 in synchronism with the cutting roller. This arrangement of parts is similar to the structure disclosed in FIG. 4 with knives 205 on the cutter drum 192 severing the stream into discrete segments as they engage the cushion portion 206 on the cushion roller 194. The box-like structure 190 has a cooling water inlet 210 to provide for cool water flow from a chiller 220 which is directed through a pipe 212 with a valve 214 therein to control the flow therethrough. The outlet of the chiller 220 also mounts a second outlet pipe 215 with a valve 218 therein which is connected to the pipe 180 for the discharge jets or nozzle 182 directing chilled water spray into the trough 175 and onto the liquid stream to solidify the same. The water in the trough spills into the cutter housing structure 190 housing the cutter wheels such that the water level is above the area in which the cutter wheels sever the streams. The two streams will be directed downwardly between the cutting an cushion wheels and are simultaneously severed as the wheels are rotated. The opposite side of the box-like structure is open near the upper extremity of the same to communicate with an upper tray 240 of the bath of cooling medium which in this embodiment is formed by a plurality of vertically aligned tray mmbers 240, 241 and 242 with water and the severed segments flowing through and between the same, as will be hereinafter noted. These are mounted in angle iron frames 248, 249 and the upper tray-like member has a ramp section 250 at the outer extremity of the same with the end beyond the ramp being open such that water and segments may spill over the end of the same and into the intermediate tray section 241 below the same which is longer than tray section 240 such that it projects beyond the end of the same to receive the water and segments. Similarly the tray-like member 241 has a ramp 252 at the extremely of the same with the tray being open beyond the end of the same to permit water and segments to fall to the lower tray 242. The lower tray-like member has a sump section 260 at the end of the same in direct communication therewith and suitable splash plates 262 are attached to the ends of the tray-like members 241, 242 receiving water and segment flow from the tray positioned above the same.

A paddle wheel or drum 280 with paddles 283 thereon is journaled on an upstanding frame portion 282 connected to the upper frame or tray member 240 and is driven by means of a belt 285 connected to pulleys 286, 287 respectively which are mounted on the shaft mounting the upper cutting roller 192 and the paddle wheel or drum 280 respectively. Thus the paddle wheel with the paddles thereon rotate to move the segments and water through the tray-like members 240, 241 and 242 to provide an elongated cooling area for the purpose of solidifying the hot melt in the segments such that when they are discharged into the sump portion 260 they are solid and substantially cooled. The sump portion 260 of the bath cooling medium has an outlet pipe 290 connected thereto leading to a pump 295 which draws water through the tray members and sump section with the outlet of the pump, as indicated by the pipe 296, being directed into the inlet of the chiller 220. A suitable inlet pipe 298 with the valve 299 therein permits interconnection of an outside fluid source to the circulating line to add water to the system. The tray-like members provide an elongated cooling bath by means of which the segments may be immersed and directed through a cooled water for the purpose of solidifying the same after severing. The pumping action of the pump 295 in this recirculating system directs the water flow therethrough and the rotation of the paddle wheel 280 with operation of the motor 200 simultaneously with the rotation of the cutting and cushion wheels will aid in the movement of the segments therethrough.

Positioned in the sump 260 of the tray member 242 or the bath cooling medium is a vertical conveyor 300 having a pair of drive and guide pulleys 301, 302, respectively, over which a pair of guide chains 304 are mounted. The guide chains mount therebetween a plurality of screen-like buckets 305 which are open at one extremity. The buckets are generally triangular in cross section and are distributed between the chains throughout the extent of the same such that they dip into the water in the sump and scoop up the segments of the glue elevating the same as the pulleys and hence the chains are rotated to lift the segments out of the water and direct them into a discharge frame 320 of the conveyor. The discharge frame includes a triangular shaped screen 322 which receives the segments as buckets are inverted at the top of the conveyor. A suitable drive motor 325 rotates the drive pulley 301 for continuous rotation of the buckets to elevate the segments out of the bath of cooling medium or the sump portion 260 thereof and into the discharge outlet or frame 320 of the conveyor. The outlet portion of the frame is generally in the form of a pyramid with the lower inclined surface 328 adapted to receive moisture or water dripping through the screen from the segments to return the same to the sump. The outlet or apex of this pyramidal shaped frame is in communication with a discharge pipe 330 of a blower 335 driven by a motor 340. Segments sliding down the screen are dropped into the discharge pipe 320 and directed by the air movement therein through the extent of the pipe to the discharge extremity 350 of the same, the latter having a sliding plate-like valve member 352 positioned in the end of the same. The length of the pipe may vary but normally will be of such extent as to direct the flow of segments to a remote point wherein they may be boxed or packaged in shipping containers as they are discharged from the end of the pipe. Movement of the air affects conveying action of the segments to the packaging location and at the same time affects a further drying of the surface of the segments removing the moisture therefrom such that as they are discharged into boxes they will be dry and suitable for packaging. The slide gate valve 352 in the end of the same permits discharge of the segments into boxes only when boxes are in position beneath the same in the packaging area.

Although we have shown a blower type conveyor, a combination of conventional conveying apparatus together with the application of air thereto for drying purposes may be readily employed for conveying segments from the machine to the packaging and shipment areas.

In the operation of this embodiment of the machine, hot melt adhesive is directed from the mixing chamber 160 through the discharge pipe thereof and to the valve controlled orifices defining the streams of liquid material. In the present embodiment a plurality of pair of streams are created which are directed down the trough-like structure 175 wherein the surface of the same is solidified by the spraying of chilled water thereon. The chilled water and the streams leave the end of the trough structure 175 and are discharged into the cutter box structure 190 housing the cutting wheels with the streams being directed between the knives of the cutting drum 191 and the cushion drum 194 such that severing of the same takes place sealing the ends of the pillow-like segments as in the before-mentioned embodiment. The two streams are simultaneously cut and the pillow-like segments which are immersed in the chilled water within the box-like structure 195 flow into the upper tray of the bath of cooling medium to be moved with the water by means of rotation of the paddle wheel 280 down the extent of the tray-like structure and from the upper to the intermediate and lower tray members providing an elongated area of cooling to solidify the molten adhesive within the pillows. As the segments reach the sump portion 160 they are raised by the conveyor 300 into the discharge end of the conveyor wherein they are deposited on the screen which is inclined such that the segments move by gravity down the stream and into the discharge pipe 330 of the blower to be moved to a point of packaging. The air in moving the segments also affects the drying of the surface of the pillows or segments such that as they are discharged from the discharge pipe they may be packaged in boxes or other suitable containers for shipment. This improved machine provides a continuous and automatic apparatus for handling the hot melt adhesive from the mixing chamber to the shipment point in a single continuous operation eliminating any handling or manual movement of the same.

In the improved method and apparatus of packaging materials, such as the hot melt adhesive, the improvement resides in handling of the adhesives in a fluid or liquid form such that the adhesive will form its own protective and containing coating by immersing the same in a cooling medium to solidify the outer surface of the same. The interior remains fluid because of the elevation in temperature and the severing operation will take place while the interior is fluid and the exterior coating while solidified is flexible such that it may be pinched off and sealed with cooling continued to a point where the individual pillows or segments are directed to a conveying apparatus where the segments are cooled and dried for permanent handling. The packaging of such materials permits processing the adhesive to a form where it forms its own package and in such a size that it may be readily handled and packaged loosely or in bulk form in shipping containers in accord with given weight requirements without exposing the molten adhesive to the working atmosphere of the processing plant or without requiring any intermediate steps or special packaging requirements.

While I have shown the improved method and apparatus applied to hot melt adhesives, it will be readily recognized that adhesives other than synthetic resins and similar material having the same characteristics and packaging problems may similarly be packaged.

What is claimed is:

1. The method of packaging a hot melt adhesive material having normally solid characteristics which becomes liquid at elevated temperatures, comprising the steps of:

a. conveying said hot melt adhesive material in the form of a molten liquid stream through a cooling medium, said hot melt adhesive having a solidification temperature in the range of 125 to 450° F. and comprising a thermoplastic synthetic resin and a substantial amount of wax, whereby said hot melt adhesive material in said form is capable of forming a semi-hard, flexible outer surface while cooling down from the molten state; said conveying through said cooling medium being containued until the outer surface of said stream is solidified by the action of said cooling medium to form a partially solidified stream comprising a solidified, semi-hard, flexible outer surface, serving as a sealing coating, enveloping the still-liquid interior; said cooling medium having a density greater than said liquid or partially solidified stream of material thus causing said liquid or partially solidified stream of material to be supported by said cooling medium;

b. severing said partially solidified stream into segments by pinching said partially solidified stream between a rotary cutting means and a cushioning means, so as to form a solid envelope or casing enclosing the liquid interior of each resulting segment;

c. circulating said cooling medium so as to move the resulting segments further through the cooling medium until said segments are sufficiently further solidified to be resistant to breakage of the solid envelopes thereof.

2. Method according to claim 1 wherein said step (b) comprises:

d. initially pinching a first portion of said partially solidified stream between a knife edge and knife-engaging compressible plastic means on said cushioning means;

e. simultaneously severing and sealing said partially solidified stream at said first portion to form the first sealed end of a solid casing surrounding said liquid interior;

f. initially pinching a second portion of said partially solidified stream, upstream from said first portion, in the same manner as step (d) and severing at said second portion in the same manner as step (e), thereby providing a sealed segment comprising a liquid interior and a solid outer surface coating pinched off and sealed at opposite ends of the segment.

3. Method according to claim 1 wherein said cutting means is a rotary cutter having knives thereon and said cushioning means is a rotatable drum having knife-engaging, compressible plastic means thereon, said rotary cutter and said rotating drum being journaled for counter-rotation to provide pinching off of said partially solidified stream between said knives and said compressible plastic means.

4. Method according to claim 1 wherein said material is a hot melt adhesive comprising a thermoplastic, synthetic resin, said hot melt adhesive having a solidification temperature within the range of 125°–450° F., said hot melt adhesive further comprising a wax.

5. Method according to claim 1 including the final step of removing and continuously conveying the segments from the cooling medium.

6. The method of packaging a material of claim 1 in which the forming of a continuous stream of the material in liquid form includes forming a plurality of streams of material with the streams being directed in liquid form into a cooling medium to solidify the same and simultaneously severing the plurality of streams of material into segments.

7. A hot melt adhesive article, made according to the method of claim 1, comprising a segment of adhesive having a pillow shape with pinched severed extremities in which the adhesive is solidified on the surface and on the extremities to form a container and in which the interior of the container is comprised of adhesive at an elevated temperature in liquid form.

8. The method of packaging a material of claim 1 and including the step of cooling, drying and conveying the material to a point of packaging.

9. The method of packaging a material of claim 8 in which the step of conveying and drying is affected by blowing the material.

10. Method according to claim 1 in which the conveying of said material through said cooling medium is carried out by maintaining said material in liquid form above its melt temperature in an elevated temperature zone, and conveying said material in liquid form from said zone into a conduit means at least partially immersed in said cooling medium, to provide a continuous liquid stream of said material with a substantially uniform dimension.

11. Method according to claim 10 in which the conveying of said material from said zone into said conduit includes the step of pumping said material in liquid form through an outlet pipe.

12. Method of claim 11 wherein heat is applied to said pump and said outlet pipe to maintain said material in liquid form.

13. Method according to claim 11 in which said conveying step includes valving the flow of liquid material from the pump to maintain the continuous stream.

* * * * *